US005092620A

United States Patent [19]

Girault et al.

[11] Patent Number: 5,092,620

[45] Date of Patent: Mar. 3, 1992

[54] BINDING FOR CROSS-COUNTRY SKI BOOT

[75] Inventors: Eric Girault, Seynod; Paul Arnulf, Alby Sur Cheran, both of France

[73] Assignee: Salomon S. A., Annecy Cedex, France

[21] Appl. No.: 507,786

[22] Filed: Apr. 12, 1990

[30] Foreign Application Priority Data

Apr. 12, 1989 [FR] France ..... 89 04824

[51] Int. Cl.[5] ..... A63C 9/00

[52] U.S. Cl. ..... 280/615; 280/627

[58] Field of Search ..... 280/615, 627, 631

[56] References Cited

U.S. PATENT DOCUMENTS

| | | | |
|---|---|---|---|
| 4,219,215 | 8/1980 | Biermann et al. | 280/615 |
| 4,239,257 | 12/1980 | Biermann et al. | 280/615 |
| 4,322,092 | 3/1982 | Feucht et al. | 280/615 |
| 4,691,936 | 9/1987 | Nowak et al. | 280/615 |

FOREIGN PATENT DOCUMENTS

| | | | |
|---|---|---|---|
| 2715907 | 10/1977 | Fed. Rep. of Germany | 280/615 |
| 2526322 | 11/1983 | France | 280/615 |

*Primary Examiner*—Andres Kashnikow
*Assistant Examiner*—Eric Culbreth
*Attorney, Agent, or Firm*—Pollock, Vande Sande & Priddy

[57] ABSTRACT

Binding for holding the front of a ski boot (3) in position on a cross-country ski (2), comprising a binding body (8), a locking piece which fastens to the ski an element (5) unitary with the front of the boot, a control device (10) for the locking piece, spring-force means (35) which, in the absence of any external force exerted on the control device (10), draw this control device into the locked position, there being associated with this control device (10) an element (36) connecting with the locking piece and a guide (64) for this control device (10) during its displacement. The position maintenance of the control device (10) on the binding body (8) is achieved by the element (36) connecting with the locking piece and the guide (64, 49) of this control device (10).

7 Claims, 2 Drawing Sheets

BINDING FOR CROSS-COUNTRY SKI BOOT

FIELD OF THE INVENTION

The present invention relates to a binding for holding the front part of a boot in position on a cross-country ski.

BACKGROUND OF THE INVENTION

Front bindings for cross-country skis are already known which comprise a locking slide movable longitudinally in a slide-track attached to the ski when acted upon by a control lever jointed to the binding shell. The slide comprises, at its front end, a transversely-positioned hook which is unitary with a core extending it rearward and which extends horizontally above a footing fastened to the upper surface of the ski. This core slides in a longitudinal track attached to the upper surface of the ski. Furthermore, the binding comprises a transversely-positioned frontal stop which is located behind the binding shell. This stop extends opposite the hook of the locking slide with which it cooperates to hold in the locked position, between itself and the hook of the slide, a transverse coupling pin fitted on the front portion of the sole of the boot. In the unlocked position, the locking slide is in a position such that the hook of the slide is moved away from the frontal stop. The front of the boot may then be coupled to the binding by inserting the transverse pin unitary with the front end of the sole in the space between the hook and the frontal stop, this pin insertion occurring in a downward direction toward the upper surface of the ski. Then, to lock the bonding, it is necessary only to maneuver the control lever of the binding so as to displace the locking slide and its hook until the latter is brought into the immediate proximity of the frontal stop. At that moment, the hook clamps the coupling pin of the boot and holds it immobile between itself and the frontal stop. This type of binding has the disadvantage of requiring that, to use it, the control lever of the binding must be operated manually.

Moreover, it is known that bindings are generally rendered unitary with the ski by means of screws penetrating through the base of this binding, thereby requiring that holes be provided in the part of the body of the binding which covers these screws, in order to allow access with a screwdriver. To prevent water from seeping into the inside of the ski at the screw positions and causing the ski to rot, or even to burst apart under the action of ice, screw covers must be provided. Now, these screw covers constitute a difficulty, first, from an aesthetic standpoint and second, as regards the additional manipulation required for their installation during the mounting operation. Furthermore, these screw covers may be lost during skiing, thus leading to the aforementioned problems.

SUMMARY OF THE INVENTION

The present invention relates to improvements incorporated into a binding of this type which make it possible to guarantee water-tightness of the binding screws; which require no additional parts; which allows access to the binding screws; and which makes possible a reduction in the number of components of binding.

Accordingly, this binding intended to hold the front part of a boot in position on a cross-country ski, which comprises a binding body fastened to the ski; a locking piece which is movable between two positions, i.e., a locked position in which it effects the fastening to the ski of an element unitary with the front of the boot and an unlocked position in which it releases this element; a locking-piece control device, mounted on the body, which is movable between a position in which it locks the locking piece and a position in which it positions the locking piece in the unlocked position; spring-force means which, in the absence of any external force acting on the control device, draw this device into the locked position; and, associated with this control device, a locking piece connecting element and a guide for this control device when the latter being displaced, is characterized by the fact that the control device is held in position on the body of the binding by means of the locking-piece connecting element and the guide for the control device.

BRIEF DESCRIPTION OF THE DRAWINGS

An embodiment of the present invention will be described below by way of example, with reference to the attached drawings in which.

DESCRIPTION OF THE PREFERRED EMBODIMENT

Figure 2:
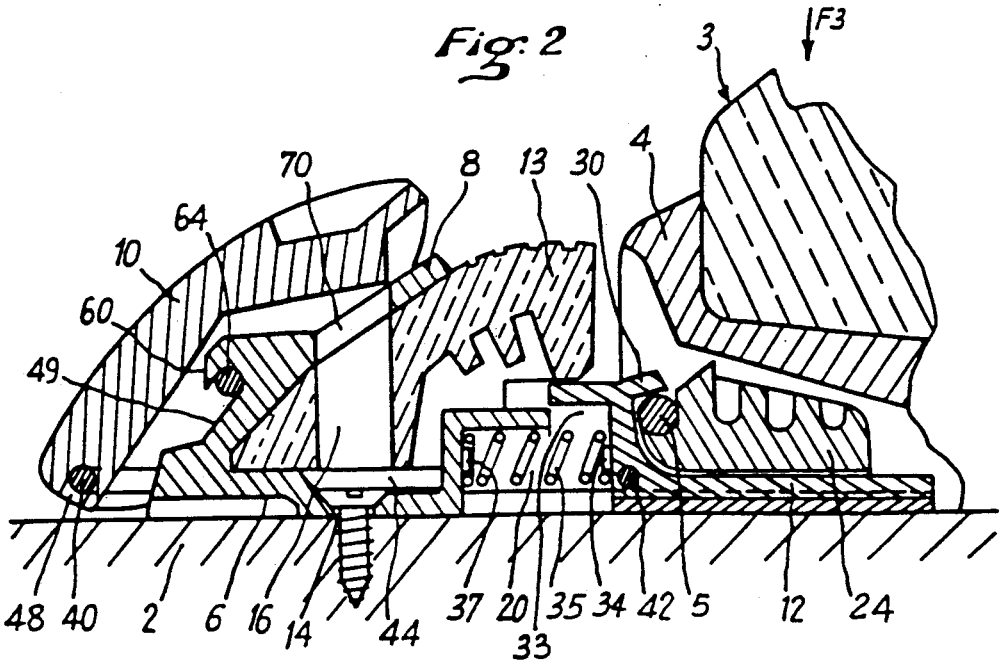
FIG. 2 is a longitudinal cross-section of a binding according to the invention, on which a ski boot has just been locked in position.

As shown in FIG. 2, the binding mechanism according to the invention is designed to hold in position on a cross-country ski 2 the front of a ski boot 3 whose sole 4 is fitted at its front end with a transverse coupling pin 5 extending in proximity to the lower surface of the sole 4. The binding mechanism according to the invention is composed essentially of a footing 6 unitary with a binding body 8, a lever 10 of a locking slide 12, and a elastic cushion 13 designed to exert a return-motion stress on the boot when the latter is raised off the upper surface of the ski.

The footing 6 is fastened to the front part of the ski 2 by means of a screw 14 penetrating a countersunk hole on the longitudinal axis of the footing 6, and to the rear part of the ski by means of two screws (not shown). A groove 18 is cut in the rear part of the footing 6; this groove, which has a rectangular section, is designed to act as a guide for the locking slide 12 and extends over substantially one-half of the length of the footing 6. Substantially in its median part, the footing comprises a housing which projects upward toward the summit of the axis parallel to the longitudinal axis of the footing 6 and opens toward the rear section of the footing.

The rear section of the footing 6 comprises an upper projection forming a stop 24, in whose frontal forward surface is provided with a transverse semi-circular, upwardly concave groove 26.

The front part of the slide 12 ends in an upper hook 30 extending transversely, and, when the slide is moved the maximum extent toward the rear of the binding, the base of this hook covers the transverse groove 26. The upper facing parts of the hook 30 and of the stop 24 have transverse chamfers, 31 and 32 respectively, which slope in opposite directions in relation to the plane of the ski so as to create, when the hook 30 and the stop come into contact, a V-shaped groove which moves the slide 12 forward, thus allowing the boot to be installed. A recess 33 is cut in the anterior surface of the slide; this recess opens toward the front of the binding, has a semi-circular cross-section, and has a longitudinal axis parallel to that of the ski 2. The bottom of the recess comprises a boss 34 intended to receive one of the ends of a compression spring 35, while the other end of this spring is supported by a boss 37 on the bottom of housing 20. Spring 35 continuously biases the locking slide 12 and the hook 30 toward the rear of the binding, i.e., toward the right-hand side of the drawing.

The connection between the lever 10 and the locking slide 12 is provided by means of a loop 36 substantially rectangular in shape when seen in top view, composed of two transverse arms, one front 40 and one rear 42, and two longitudinal arms 44. The rear transverse arm 42 is divided in the middle so that each of the sections thus obtained engages in a housing in each of the lateral surfaces of the slide 12. The longitudinal arms 44 of the loop 36 extend into two longitudinal housings 46 on the binding body 8. In the absence of forward longitudinal stress exerted on the loop 36, the compression spring 35 moves the locking slide 12 toward the rear of the binding until it comes into contact with the front surface of the stop 24, in which location the lower surface of the hook covers the transverse groove 26.

The body of the binding 8 comprises on its front surface, a transverse ramp 49 sloping upward and rearward in relation to the plane of the ski. The upper part of this ramp ends in a housing 52 having a semi-circular section. The wall of this housing opposite the ramp 49 continues to extend downward parallel to this ramp, and connects with a transverse, vertical ramp 60 which extends toward the upper part of the binding body 8. The upper part of this body has a hole 70 intended to allow access to the attachment screw 14. The rear wall of the binding body 8 opens outward so as to receive the elastic cushion 13, which has an opening 16 perpendicular to the plane of the ski constituting an extension of hole 70 providing access to the screw 14.

The lever 10 is constituted by a slightly convex main surface of the same width as the body of the binding 8, which comprises two facing lateral arms, whose bases end substantially in an arc 62. It incorporates in its lower part a transverse housing 48 which opens downward along its entire length, thereby enabling it to fit over the front transverse arm 40 of the loop 36.

A transverse, horizontal pin 64 extends between the two of housing 20. Spring 35 continuously biases the locking ends.

Figure 1:
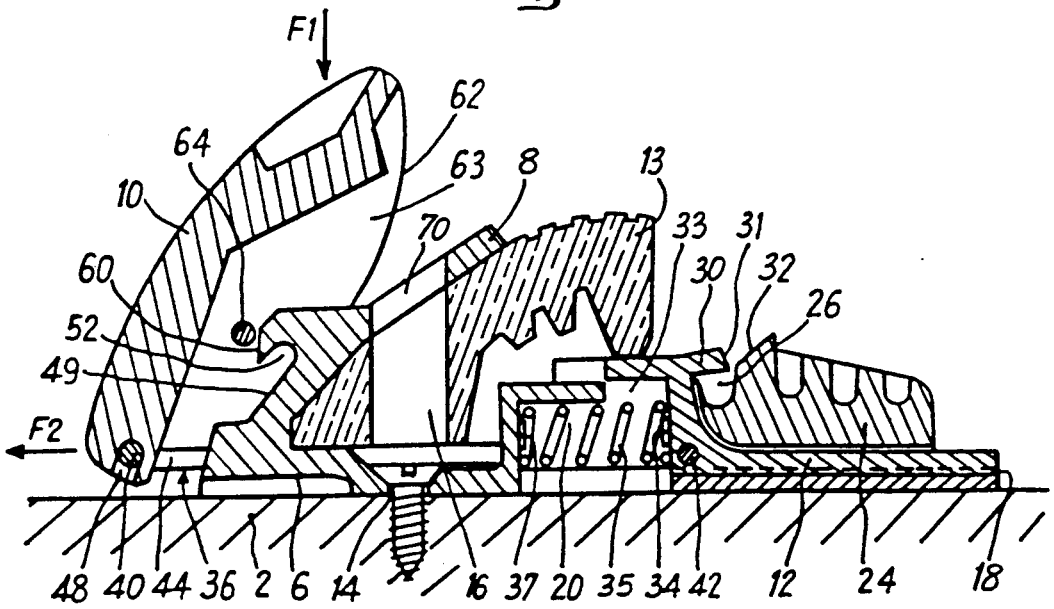
FIG. 1 is a longitudinal cross-section of a binding according to the invention during the mounting of the locking-piece control device on the binding.

FIG. 1 shows the binding in position prior to the mounting of the lever, a position corresponding to its position when delivered. In this position, the lever 10 is engaged, by means of its transverse housing 48, on the front transverse arm 40 of the loop 36, and the orifice 70 is left uncovered, thereby allowing access by screwdriver to the screw 14 which attaches the front part of the binding 8 to the ski. The lever 10 is then joined to body of the binding 8 by a kind of catch mechanism, which is produced by pressing on the lever 10 in the direction of the arrow F1 and by pressing in this way the pin 64 against the vertical ramp 60 of the body of the binding 8. The pin 64 then slides downward on the ramp 60, an action causing the longitudinal forward movement of the arm 40 in the direction of the arrow F2, in opposition to the spring 35, until it slips off this ramp 60 and, under the action exerted by the spring 35, fits into the bottom of the housing 52. The lever 10 is then joined to the body 8 by virtue of the fact that it fits onto the arm 40 and that the spring 35 causes its pin 64 to abut against the body 8. The boot is then locked in position as shown in FIG. 2. At this point, the lever 10 seals the orifice 70, and will continue to seal it even when it is displaced, thereby preventing any snow from penetrating the body of the binding 8 and thus also the screw assembly 14, for as long as the lever 10 is not unfastened from the body of the binding 8. Furthermore, in this position, any accidental return of the lever 10 to the disassembled position is prevented, since its pin 64 is embedded in the housing 52 by virtue of the force exerted by the spring 35.

To attach the boot 3 to the ski 2, the skier engages the transverse coupling pin 5, located on the front of his boot 3, into the V-shaped groove formed by the chamfers 31 and 32, and applies a downward force in the direction of the arrow F3. The transverse coupling pin 5, guided along the two sloping planes 31 and 32, pushes the hook 30, and thus the slide 12, toward the front of the binding, in opposition to the compression spring 35, and is inserted in the groove 26. The slide 12, acted upon by the spring 25, returns to its preceding position and comes into contact with the frontal part of stop 24, thereby ensuring that the hook 30 will lock the transverse coupling pin 5 into position.

As shown in FIG. 2, the boot 4 is then locked on the ski while retaining the ability to pivot around the transverse pin 5. It will be noted that, during cross-country skiing, the longitudinal force applied by the boot 3 of the skier on the binding is applied, first, by the coupling pin 5, sometimes on the anterior frontal surface of the stop 24 and sometimes on the anterior surface of the groove 26, but not on the hook 30; and second, by the sole 4 of the boot 3 on the elastic cushion 13. The only stress exerted by the transverse pin 5 on the hook 30 during cross-country skiing is a vertical upward stress which, since it is perpendicular to the lower surface of the hook 30 and, therefore, perpendicular to the direction in which this hook is capable of being displaced, will not affect the longitudinal displacement of the slide 12.

Figure 3:
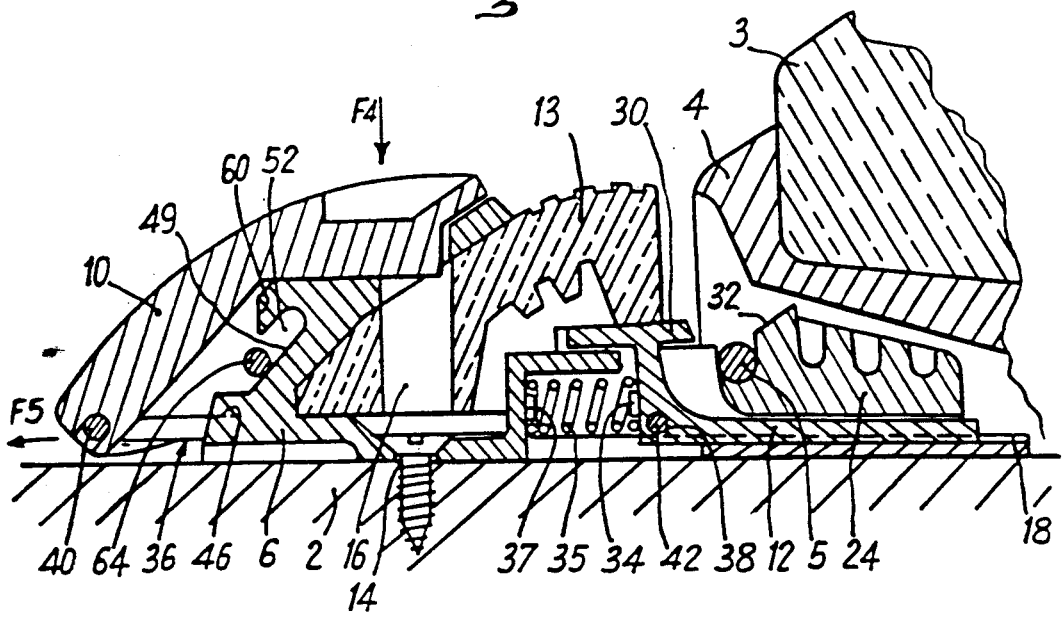
FIG. 3 is a longitudinal cross-section of a binding according to the invention during release.

To unhook the boot, as shown in FIG. 3, the lever 10 is pressed downward in the direction of arrow F4. During this operation, the pin 64 of the lever 10 slides downward and forward on the sloping ramp 49. The lower part of the lever 10 then moves longitudinally forward in the direction of the arrow F5 and draws the slide 12 with it in opposition to the return force exerted by the spring 35. The hook 30 then releases the transverse coupling pin 5 of the boot 4, and the user may, at this stage, remove the boot from the binding.

When the lever 10 is released, the compression spring 35 pushes the slide 12 toward the rear of the binding and, by means of the loop 36, pulls the lower part of the lever 10 rearward. The pin 64 of the lever 10 then slides rearward and upward on the ramp, until it returns to its stopped position in the housing 52.

Figure 4:
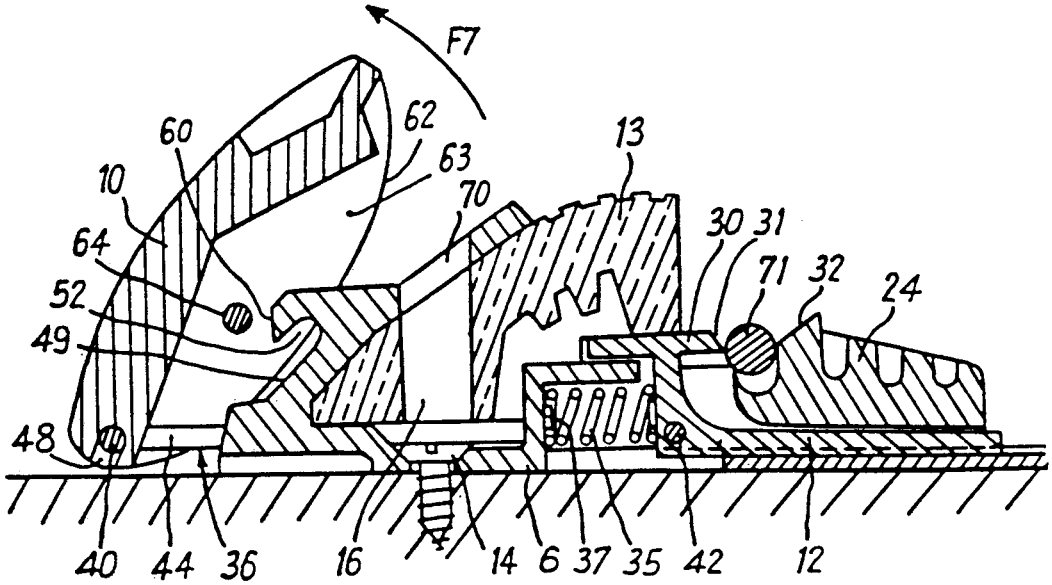
FIG. 4 is a longitudinal cross-section of a binding according to the invention during the dismantling of the locking-piece control device.

It will be noted that it is possible to dismantle the lever 10 by executing a movement which is the reverse of that performed to mount it. To dismantle the lever 10 from the body of the binding 8, therefore, the user presses downward on the lever 10, as shown in FIG. 3, in the direction of arrow F4, so as to move the hook 30 away from the stop 24 as far as possible, and to cause the pin 64 to be lifted from the ramp. Such a movement may be made by inserting between these two elements, as illustrated in FIG. 4, a cylindrical pin 71 whose diameter is greater than the path travelled by the lever 10 during the unlocking movement. Under these conditions, the slide 12 is immobilized, as are the loop 36 and its transverse arm 40, which acts as the rotational axis of the lever 10, and the latter may then be released from this arm 40.

It will be noted that the dismantling of the lever 10 is in fact obtained by displacing this lever in the same direction as that in which the displacement of this lever for release of the binding occurs, but over a greater distance, thereby allowing the pin 64 to be lifted off the ramp 60.

It will also be seen that, in this binding according to the invention, the maintenance of the locking-piece control device, or lever 10, in position on the body 8 of the binding is obtained not by means of a special part, but by means of components which already exercise another function in this binding, i.e., the loop 36, which also connects this lever to the slide and, therefore, transmits the movements of the lever to the slide; the pin 64, which also acts as a guide piece for the lever; and the spring 35, which also draws the locking piece into the locking position.

A construction of this kind makes possible a reduction of the number of parts, and is thus particularly advantageous from an economic perspective, especially in the area of cross-country skiing in which lightness requirements are of first importance.

What is claimed is:

1. Automatic binding for holding a front of a ski boot (3) in position on a cross-country ski (2), said binding comprising (a) a binding body (8) fastened to said ski;

(b) a locking piece having a stable locking position in which said locking piece fastens to said ski an element (5) unitary with the front of said boot;

(c) said locking piece being elastically movable towards an unlocked position in which said locking piece is adapted to release or receive said element (5), against a return force of spring force means (35) holding said control device (10) on said binding body (8) and drawing said locking piece (30) into said locking position;

(d) a movable control device (10) for actuating said locking piece toward said unlocked position;

(e) connecting means (36) connecting said control device (10) to said locking piece (30); and (f) guide means (49, 64) on said binding body (8) and said control device (10) to effect actuating of said locking piece toward an unlocked position when said control device is moved, said guide means of said control device (10) being constituted by a transverse pin (64) unitary with said control device and sliding in associated guide means (49) of said binding body (8), said transverse pin (64) being drawn by said spring force means (35) into a position abutting said guide means (49) of said binding body (8) in a direction opposite to a direction in which said control device (10) is displaced for unlocking said binding.

2. Automatic binding according to claim 1, wherein said guide means (49) of said binding body (8) comprises a sloping ramp (49) having an upper part terminating in a housing (52) in which, under the force exerted by said spring force means (35), said transverse pin is fitted when, in the locked position, no external force is exerted on said control device (10).

3. Automatic binding according to claim 2, wherein said connecting means (36) is constituted by a loop which is rectangular in form when seen in plan view and which comprises two transverse arms, one forward (40) and one rear (42), and two longitudinal arms (44), said rear transverse arm (42) being unitary with said locking piece (12), and said control device being pivotally mounted on said forward transverse arm (40) of said loop (36).

4. Automatic binding according to claim 1, wherein said binding body (8) comprises, at its base, a hole for a screw (14) for fastening said binding body (8) on said ski (2), an upper part of said binding body having, in a straight line with said screw (14), an orifice for insertion of tightening means for said screw, said orifice (70) being covered by said control device (10) when said transverse pin (64) is in contact with said guide means (49), and being uncovered when said transverse pin (64) is no longer in contact with said guide means (49).

5. Automatic binding according to claim 1, wherein said binding body comprises, in a rear part thereof, a frontal stop (24) comprising a transverse groove (26) having a semi-circular section for receiving said element unitary with the front of said boot, said element being locked in said transverse groove by said locking piece (30).

6. Automatic binding according to claim 1, wherein said binding body (8) comprises, on a front surface thereof, a transverse vertical ramp (60) located above said guide means (49), said vertical ramp (60) forming an abutting surface of said control device (10) prior to mounting of said control device and forming a sliding surface for said transverse pin when, during mounting, said control device (10) is lowered and displaced longitudinally.

7. Automatic binding according to claim 6, wherein a said control device (10) is displaced during mounting thereof by a greater distance than during unlocking of said binding.

* * * * *